United States Patent [19]

Shishido

[11] Patent Number: 4,577,865

[45] Date of Patent: Mar. 25, 1986

[54] ATHLETIC BALL

[75] Inventor: Hideomi Shishido, Hiroshima, Japan

[73] Assignee: Molten Corporation, Hiroshima, Japan

[21] Appl. No.: 620,289

[22] Filed: Jun. 13, 1984

[30] Foreign Application Priority Data

Jun. 16, 1983 [JP] Japan ..... 58-109053
Mar. 26, 1984 [JP] Japan ..... 59-58978

[51] Int. Cl.[4] ..... A63B 41/00
[52] U.S. Cl. ..... 273/58 G
[58] Field of Search ..... 273/58 E, 58 G, 213, 273/65 EF

[56] References Cited

U.S. PATENT DOCUMENTS

| | | | |
|---|---|---|---|
| 2,849,819 | 9/1958 | Murphy | 46/230 |
| 3,580,575 | 5/1971 | Speeth | 273/58 |
| 4,440,400 | 4/1984 | Neuberger | 273/58 G |

OTHER PUBLICATIONS

"High-Resiliency PUR Foam Meets a Special Molding Requirement", Modern Plastics International, p. 26, (Dec. 1982).

*Primary Examiner*—Richard C. Pinkham
*Assistant Examiner*—Vincent A. Mosconi
*Attorney, Agent, or Firm*—Armstrong, Nikaido, Marmelstein & Kubovcik

[57] ABSTRACT

An athletic ball comprising (a) a ball having an airtight bladder with an air injecting valve, (b) a housing provided with the ball on the opposite side of the valve without interfering the airtightness of the bladder, a detector for detecting an application of external force to the ball, an operation converter for converting the detected impact signal to a numerical information signal, a display for displaying the numerical information and/or for generating a sound according to the numerical information, and a battery power source; the converter, display and battery power source being accommodated in the housing, and the sum of the weights of all of the above elements being adjusted to the weight which does not substantially interfere the impact resilience of the bladder and is substantially the same as that of the valve.

19 Claims, 23 Drawing Figures

ATHLETIC BALL

BACKGROUND OF THE INVENTION

The present invention relates to an athletic ball, particularlly to an athletic ball used in games such as soccer ball lifting game and Japanese traditional Kemari which are to compete for the number of kicks before the ball falls on the ground or in the duration time of the ball in the air.

When ball lifting which is a soccer player technique, namely, the exercise that one player keeps a ball without dropping it on the ground by using the instep, knee, chest, forehead and others, is employed as a game to compete for the number of kicks, the ball keeping time or the duration time in the air, ususally the number of kicks must be counted by a man. Especially it is impossible to translate difficulty of the technique such as the ball keeping time and the duration time of each kick into points by the player's individual judgement without another man for measurement. Even a man assists to measure, subjectivity is included in the judgement of technical difficulty, and thus the objective evaluation is difficult. In an infant's game Temari (dribble game) it is difficult for an infant to play while counting the number of actions. Accordingly, it is very convenient if the number of actions is automatically counted.

An infant's toy ball which makes sound on a kick has been known, for instance, in U.S. Pat. No. 2,849,819. In such a ball the outgoing of air from the inside of the ball or the rolling of a bell put in the ball is used for such a sound source, but it is impossible to vary the sound depending on the action or the situation. Thus, it is not suitable for the games to compete for the high technique of lifting or dribble.

An object of the present invention is to provide an athletic ball which enables the objective evalution, comprising means for external force counting, means for displaying and means for sound emission in the ball itself. The athletic ball encounts the external force applied to the ball automatically when kicked and displays the difficulty of the athletic technique which is translated into numerical values. Also the athletic ball enables a player to concentrate in the game becuase the ball itself notifies the player at every kick, first kick, last kick, and violation of the rule with different sounds.

SUMMARY OF THE INVENTION

The present invention relates to an athletic ball, comprising (a) a ball having an airtight bladder for giving impact resilience to the ball in which compressed air is charged through an air injection valve, (b) a concave housing provided with the ball on the opposite portion of the valve and being in contact with the surface of the bladder while keeping the airtightness of the bladder, (c) a cover for concealing the opening of the housing, (d) means for detecting an external force applied to the ball, (e) operation means for converting the signal from the detecting means into a numerical information signal relating to the external force, (f) display means for displaying the numerical information obtained in the operation means, and (g) a power source for driving the above means, said means (d),(e), (f) and (g) being acommondated in the housing, and the sum of the weights of the housing (b), the cover (c) and the means (d), (e), (f) and (g) being adjusted to the weight which does not substantially interfere the impact resilience of the ball and is substantially the same as the weight of the valve.

DETAILED DESCRIPTION

Figure 1:
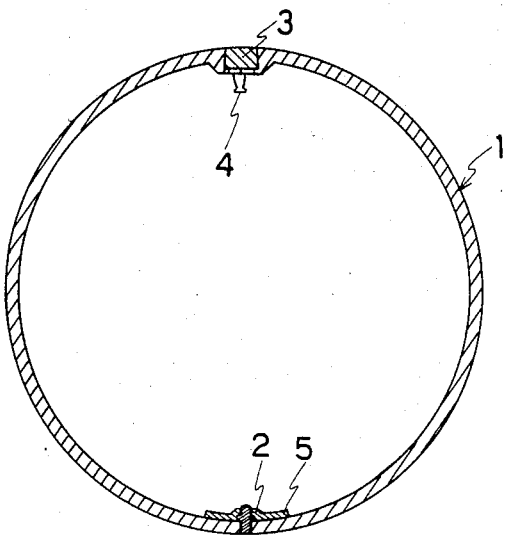
FIG. 1 shows a sectional view of an embodiment of the present invention.

FIG. 1 shows a sectional view of an athletic ball 1 which is, for instance, formed to the size of a soccer ball used in lifting games. The ball 1 comprises an air injection valve 2, a circuit unit 3, a pressure sensor 4 used as the detecting means which is placed opposite of the valve 2. The weights of the circuit unit 3 and the pressure sensor 4 are adjusted so as to be balanced with the weight of the valve. Namely the weight of valve 2 is 8 to 9 g in general, while the sum of the weights of the circuit unit 3 and the pressure sensor 4 is approximately 15 g to 20 g. In such case, a balancer 5 is attached on the side of the valve 2 for setting the weights of both sides substantially equal.

Figure 2:
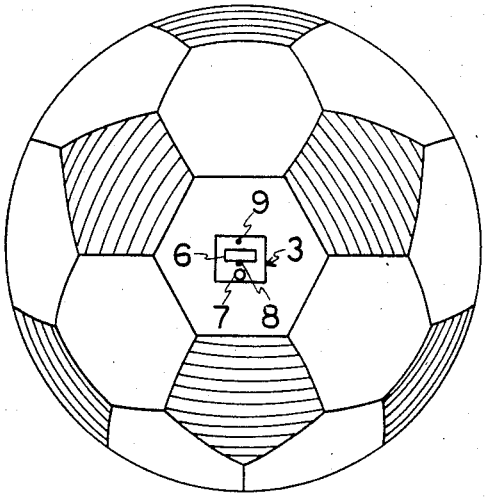
FIG. 2 shows a front view of the embodiment according to FIG. 1.

In FIG. 2, a display panel 6 is provided on the surface part of the circuit unit 3, on which the numerical information menthioned hereinafter is digitally displayed. The circuit unit 3 is buried in the ball 1, so that the surface of the circuit unit 3 and the surface of the ball 1 have a common surface. The circuit unit 3 includes an elastic bushing 7 which seals a battery case, a hole 8 with a switch and a hole 9 with a buzzer. Both switches are designed to avoid direct exposure to external forces.

Figure 3A:
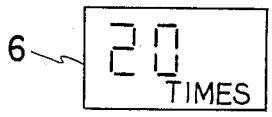
FIGS. 3*a* and 3*b* show views of display panels used in the present invention.
Figure 3B:
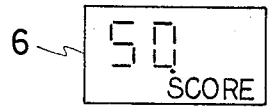
Figure 18:
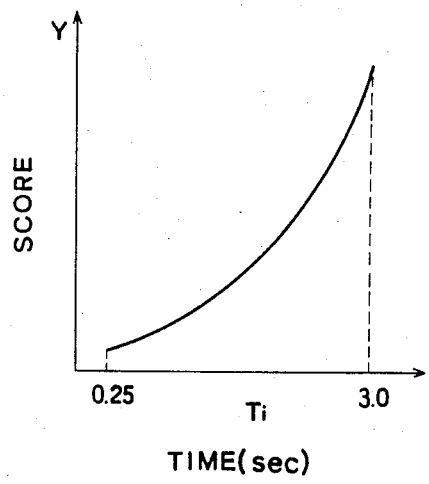
FIG. 18 shows a program flow chart for processing the present invention.

In FIGS. 3*a* and 3*b* the display surface of the display panel 6 is shown, and in this embodiment two kinds of information are displayed alternately, for instance, with the interval of one second. Namely, the number in FIG. 3*a* represents the number of liftings, while the number in FIG. 3*b* represents the score converted from the number of liftings and the difficulty of technique. The difficulty means the height of ball 1 in each kick, i.e. the duration time in the air, and the time interval from one kick to another one is detected and converted to scores. The score increases in a geometric ratio as the time interval increases, as shown in FIG. 18.

Figure 4:
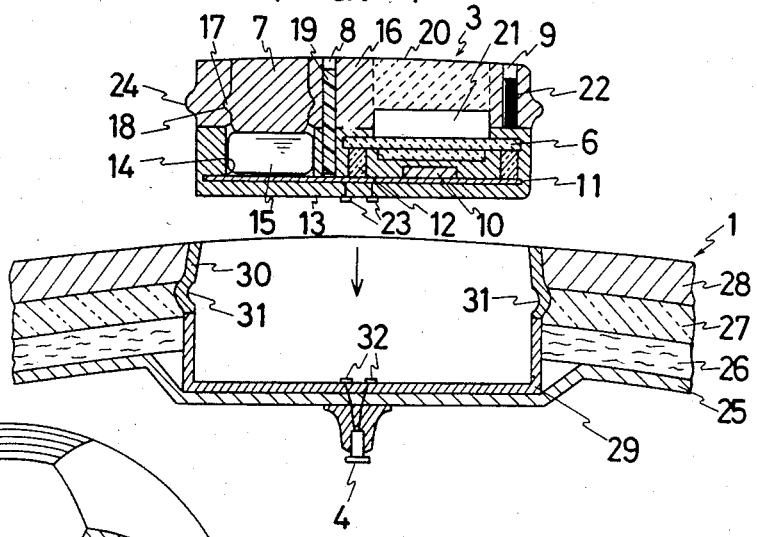
FIG. 4 shows a sectional view of an electoronic circuit and a ball used in the present invention.

In FIG. 4 the circuit unit 3 and the part of the ball 1 are shown. The circuit unit 3 comprises the display panel 6. As the display panel 6, a thin, low power consumption type display panel such as a liquid crystal display panel or an electrochromic display panel is preferably used. A light emitting diode may be also used. As a preferable liquid crystal display panel, a flexible structure panel with a liquid crystal containing a spacer corpuscle or an electroluminescence display panel is adequate, whereby the impact resistance of the display panel is improved. When an electrochromic display panel is used, strength of the panel can be improved by employing a solid electrolyte to make the panel solid. An LSI 10 composes a microcomputer which is fixed on a board 11. A connector is made of an electric conducting rubber or the like, and connects with the wiring on the board 11 and with that of the display panel 6. The display panel 6, the board 11, the LSI 10 and the connector 12 are integrally molded by a resin member 13. A battery housing hole 14 is provided with a part of the resin member 13, in which a battery 15 is fixed to and in contact with the board 11. The electrical contact of the battery 15 with the board 11 may be achived with a contact member (not shown) placed at the side wall of the battery housing hole 14. On the resin member 13 a protection layer 16 of elastic material is adhered. The protection layer 16 relieves the external impact applied to the display panel 6, the LSI 10 and the like. As the elastic material, a rubber or a resinous material with elasticity may be used. As the resin member 13, a hard resinous material is adequate. A rubber material such as a silicone rubber can also be used instead of the resin member 13. In such case the rubber material is filled in the hole and used as an integral part. The elastic bushing 7 may be made of the same material as of the protection layer 16. When pressed into, the bushing works so as to press the battery 15 on the board 11. The elastic bushing 7 has a projection 17 provided on the periphery thereof. The projection fits to a groove 18 provided with the protection layer 16 to prevent the bushing from coming off easilly. A stick shaped switch 19 is placed in the hole 8 communicating with the resin member 13 and the protection layer 16. The switch 19 works as a multiple function switch oparative as a power switch and a counting reset switch. The switch 19 is buried for avoiding direct exposure to the external forces. Therefore, a slender stick is used for its operation. Discrimination of the functions can be achieved by the number of operations. For instance, the multiple switch 19 may be designed so that one operation turns on or off the power supply, while two consecutive operations reset a counter. The numeral 20 indicates a display window made of a transparent elastic material, and space 21 is defined between the display window 20 and the display panel 6 in order to relieve the external force applied to the panel 6. A buzzer 22 is equipped inside the hole 9 which is formed in the protection layer 16. The numerals 23 and 24 indicate an electrical contact formed at the bottom of the resin member 13, and a projection formed on the side of the protection layer 16, respectively.

The ball 1 comprises a bladder 25 made of an elastic material around which a thread wound layer 26 is provided for covering the periphery of the bladder 25. Outside of the layer 26 an intermediate layer 27 made of a rubber and a surface layer 28 of a natural or an artificial leather are provided in turn. The numeral 29 indicates a bowl shaped casing of a hard resinous material whose bottom is adhered to the bladder 25. The whole sides from the top of the casing 29 to the surface layer 28 are covered with an elastic layer 30 which defines a narrow opening and has a groove 31. On the bottom surface of the casing 29, contacts 32 are provided. The contacts 32 connect to the pressure sensor 4 attached inside the bladder 25. A valve rubber is used to hold the sensor 4. As the pressure sensor 4, a sensor using a strain guage or a diffusion semiconductor is adequate.

When the circuit unit 3 is pressed into the bowl shaped casing 29, the projection 24 of the protection layer 16 fits to the groove 31 of the elastic layer 30, which prevents the circuit unit 3 from coming off. At the same time, the narrow opening on the ball surface can assist the tight fitting. In order to insure the prevention of the circuit unit 3 from coming off from the opening, some rubber pieces may be attached over the opening in a form of cross-linkage structure for holding the circuit unit 3.

Figure 5:
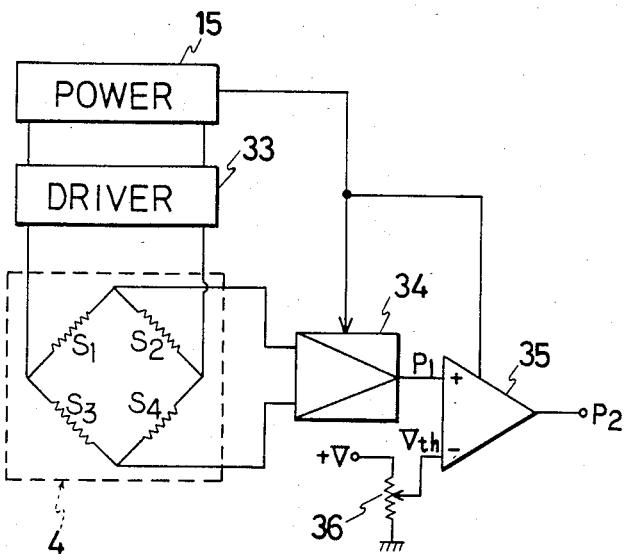
FIG. 5 shows a circuit diagram of a sensor and its peripheral circuit used in the present invention.
Figure 6:
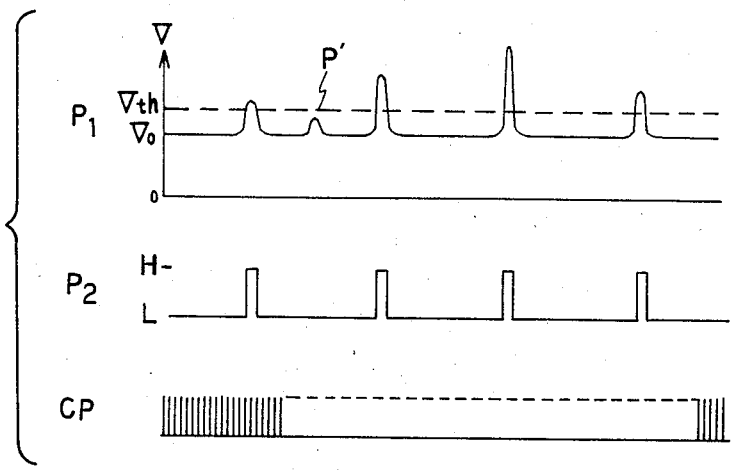
FIG. 6 shows a signal waveform chart obtained in the circuit according to FIG. 5.

In FIG. 5, the strain gauge pressure sensor 4 consists of four strain gauges (S1), (S2), (S3) and (S4) in bridge connection. For driving the sensor, a driver circuit 33 is used. As the driver circuit 33, it is preferable to employ a constant voltage circuit, because when a lithium battery cell is used as the battery 15, its output voltage is approximately 3.0 V, which drops with time, while constant voltage of 0.5–2.0 V is required to drive the pressure sensor 4 and to detect the pressure change accurately. The pressure sensor 4 detects the change of an air pressure of the inside of the ball 1, and outputs an electrical pulse signal when the inner pressure rises rapidly by a kick. The detection signal from the pressure sensor 4 is amplified by an amplifier 34 whose output is an impact pulse P1. The pulse P1 corresponds to the kicking action, and the height of pulse is proportional to the impact intensity. The pulse P1 is shown in FIG. 6, and the voltage Vo in FIG. 6 corresponds to the inner pressure (about 0.45 kg/cm$^2$) of the ball 1. The signal P1 is applied to a + side terminal of a comparator 35 while the reference voltage Vth obtained by dividing constant voltage +V with a variable resistor 36 is applied to a − side terminal. The reference voltage Vth is greater than the voltage Vo so that noise from the pressure sensor 4 or week impact pulse is eliminated, whereby the minute pulse P′ included in signal P1 (FIG. 6) can be cut off. As a result, a significant impact pulse P2 is output at the output terminal of the comparator 35. The signal CP in FIG. 6 is the waveform of the clock pulse generated by oscillator 37 (FIG. 17) explained hereinafter.

Figure 7:
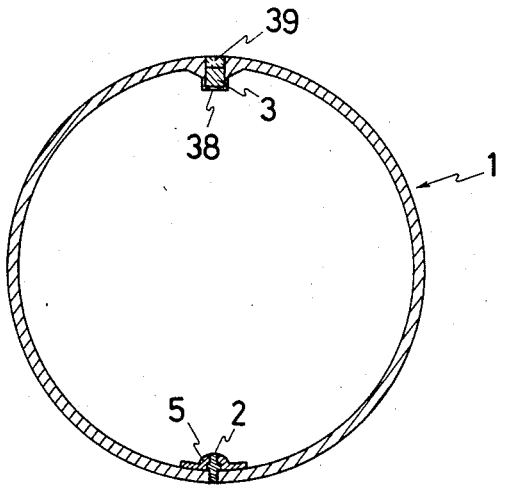
FIG. 7 shows a sectional view of another embodiment of the present invention.

Another embodiment of the present invention is shown in FIG. 7. This embodiment is simular to the embodiment of FIG. 1 except that an opening of a housing 38 which can accomondate the circuit unit 3 is concealed by a cover 39.

Figure 8:
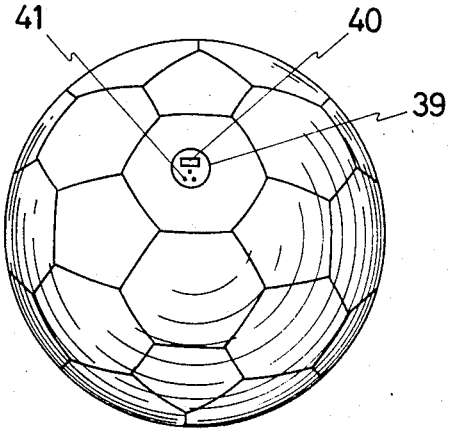
FIG. 8 shows a front view of the embodiment according to FIG. 7.

The surface of the ball 1 is shown in FIG. 8. The cover 39 has a transparent display window 40 and sound emitting bores 41 consisting of small bores. From the display window 40 the numerical information displayed on the display panel 6 of the circuit unit 3 can be seen. The cover 39 is made of an elastic material such as a rubber or a resinous material with elasticity, and at least the part thereof corresponding to the display panel of the circuit unit 3 is made of a transparent material. The cover 39 may be totally made of an opaque material. In such case readout of the numerical information displayed on the display panel must be performed by removing the cover 39.

Figure 9:
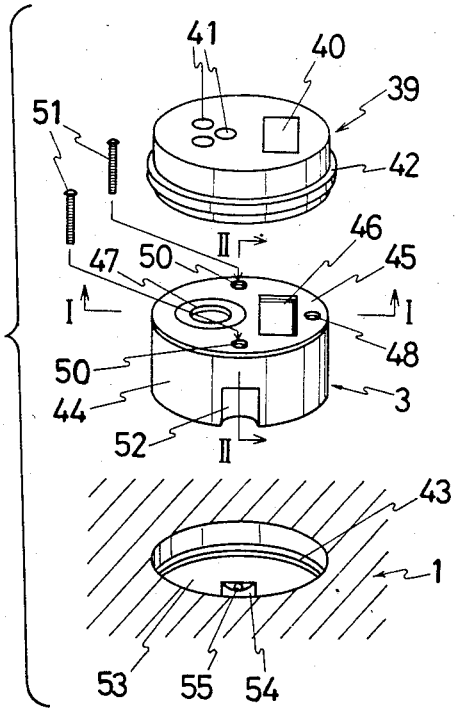
FIG. 9 shows a perspective view of each member used in the embodiment according to FIG. 7.

FIG. 9 shows a state in which the circuit unit 3 is detached from the ball 1. The cover 39 has a projection 42 around the side wall and is fixed to the ball 1 by fitting the projection 42 to a groove 43 formed on the ball 1 side. The circuit unit 3 comprises a resinous mold body 44, a soft elastic membrane 45 of a rubber or others which is adhered to the surface of the mold body 44, a display window 46 of the display panel 6, a piezoelectric buzzer 47 located at a position corresponding to the sound emitting bores 41, a bore 48 in which a multiple function switch 49 (FIG. 10) having power switch function and counting reset switch function is accomodated, and bores 50 through which screws 51 are inserted.

As the construction of the switch 49, a conventional construction can be employed. For instance, a contact provided on the board 11 is covered with a cap-shaped electrically conductive rubber. The switching operation may be oparable by pressing the electrically conductive rubber cap with a thin rod to contact the rubber cap with the contact. On the side of the mold body 44, a semicircular depression 52 is formed. The screws 51 project out to the depression 52 and are fastened at the screw bores 55 which are provided on projections 54 formed in a casing 53 of the ball 1. The casing 53 is made of a hard synthetic resin or a light metal. The depressions 52 and the projections 54 nearly coincide in surface shape, which is available for positioning and antirotating the circuit unit 3 in the casing 53.

Figure 10:
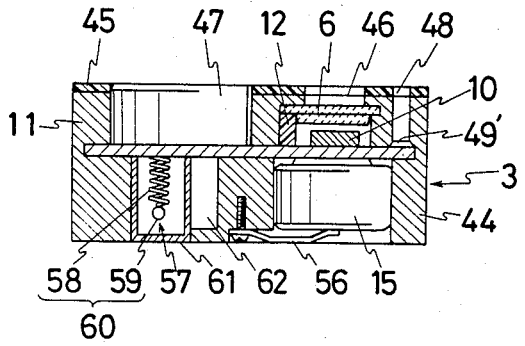
FIG. 10 shows a sectional view of the circuit unit in FIG. 9 on I—I line.

The structure of the circuit unit 3 used in the embodiment of FIG. 9 is shown in FIG. 10. In this embodiment, the circuit unit 3 comprises simular parts to those in the embodiment of FIG. 4, e.g. the display panel 6, the LSI 10, the board 11, the connector 12, the battery 15, the synthetic resin mold body 44, the soft elastic membrane 45, the piezoelectric buzzer 47 and the bore 48 having the multiple switch 49 therein.

The battery 15 is pressed on the board 11 with a spring electrode 56 screwed to the mold body 44. The numeral 57 indicates an impact sensor which detects the external force applied to the ball 1. The impact sensor 57 comprises a vibrating electrode 60 consisting of a coil spring electrode 58 with a weight electrode 59 fixed to the end of the electrode 58 and a cylindrical fixed electrode 61 enclosing the vibrating electrode 60. For increasing the sound intensity generated by the piezoelectric buzzer 47, a step up coil 62 is provided.

Figure 11:
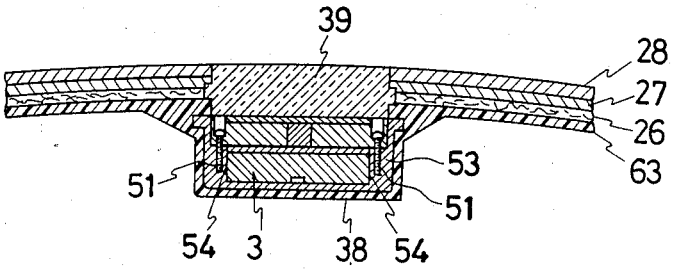
FIG. 11 shows a sectional view of the assembled embodiment in FIG. 9 on II—II line.

In FIG. 11 the state of the circuit unit 3 attached to ball 1 is shown. In FIG. 11 the housing 38 is molded integrally with or adhered to the airtight bladder 63 without interfering the airtightness thereof. The housing 38 may be made of the same rubber material as of the bladder 63, such as a butyl rubber. The casing 53 is made of a hard synthetic resin or a light metal such as aluminum. The side of the casing 53 is buried in the housing 38. The casing 53 is provided with the projections 54 and screw bores 55 (FIG. 9) to which the circuit unit 3 is fixed with the screws.

Figure 12:
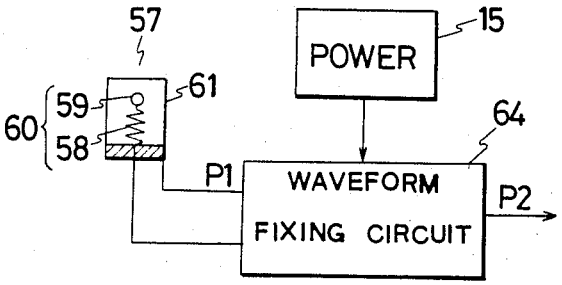
FIG. 12 shows a circuit diagram of an impact sensor and its peripheral circuit used in the present invention.
Figure 13:
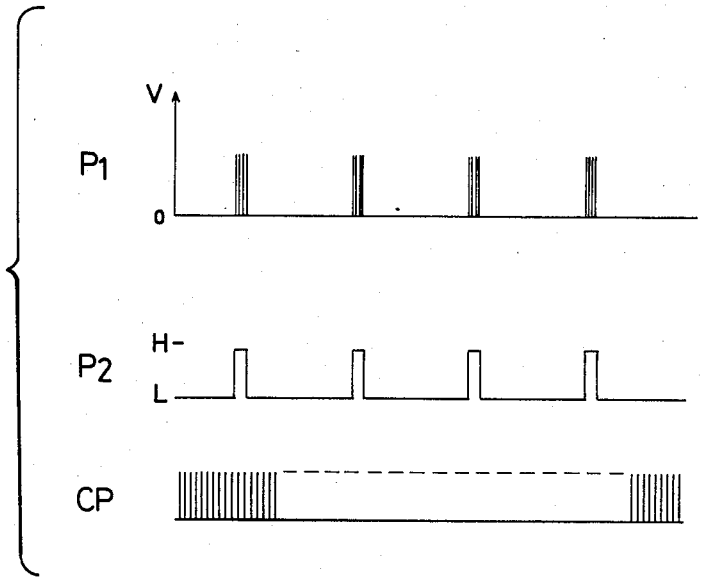
FIG. 13 shows a signal waveform chart obtained in the embodiment according to FIG. 12.
Figure 17:
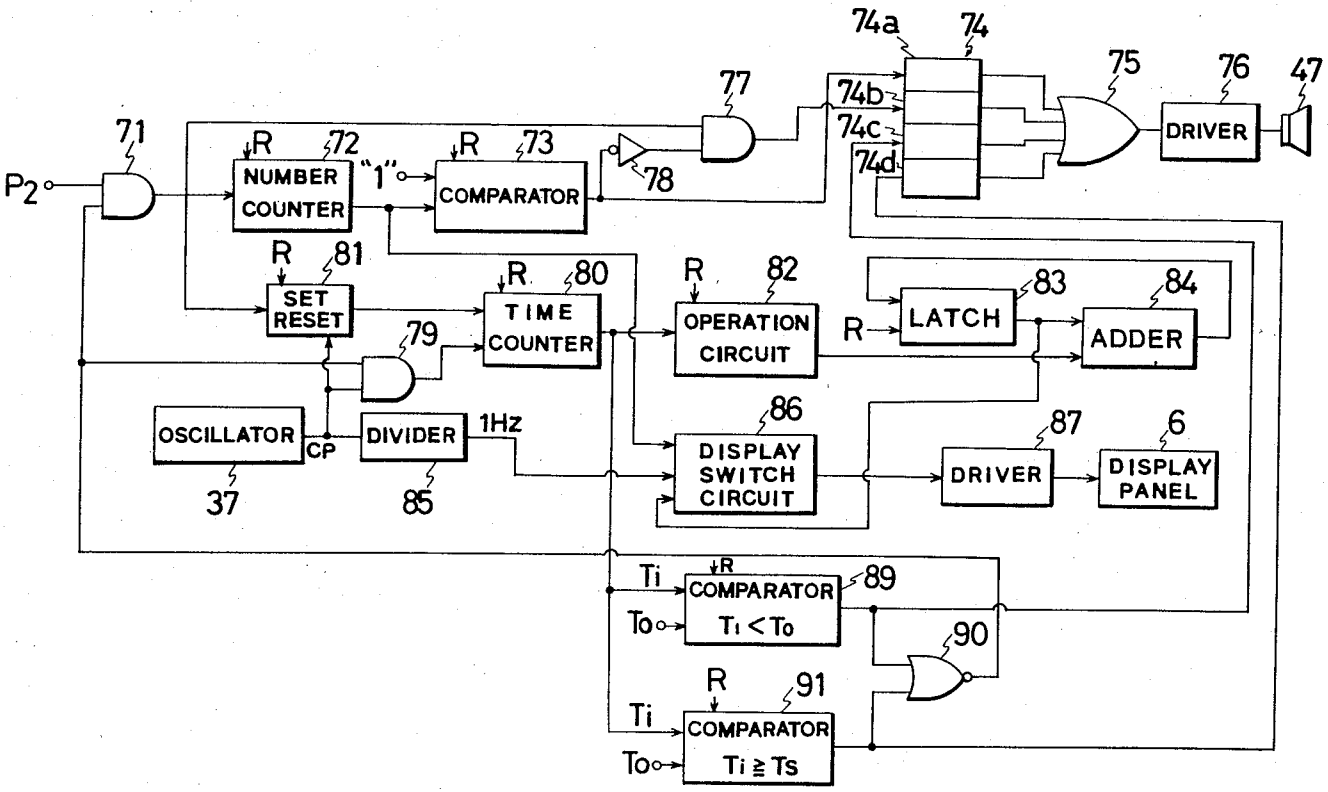
FIG. 17 shows a signal processing circuit diagram used in the present invention.

FIG. 12 shows a circuit diagram of the impact sensor 57 and its peripheral circuit. The impact pulse P1 is generated by the impact sensor 57 when an external force is applied to the ball 1. The pulse P1 is applied to a waveform fixing circuit 64 which is driven by the battery power supply 15. The waveform fixing circuit 64 produces an impact pulse P2. The waveforms of the pulses P1 and P2 are shown in FIG. 13. In FIG. 13 CP is the waveform of the clock pulse generated by an oscillator 37 (FIG. 17).

As the battery 15, there may be employed a lithium cell, a silver oxide cell, a mercury cell, an alkaline battery, and the like. Those batteries are suitable to the present invention due to their light weight, e.g. about 1 to 3 g, and large capacity.

Figure 15:
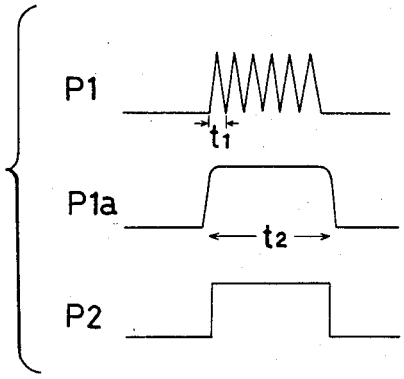
FIG. 15 shows a signal wageform chart obtained in the circuit according to FIG. 14.

It is preferable to employ a commercially available integrated circuit (IC) as the waveform fixing circuit 64. In general a chattering omitting circuit is incorporated in such an IC, which omits a pulse of about 1 msec. as an invalid signal. However, as shown in FIG. 15, the detected impact signals are usually obtained in a form of successive short pulses P1 having a duration time $T_1$ of about 1 msec. to several miliseconds, the impact signal P1 is processed as a chattering signal, which causes miss of detection.

Figure 14:
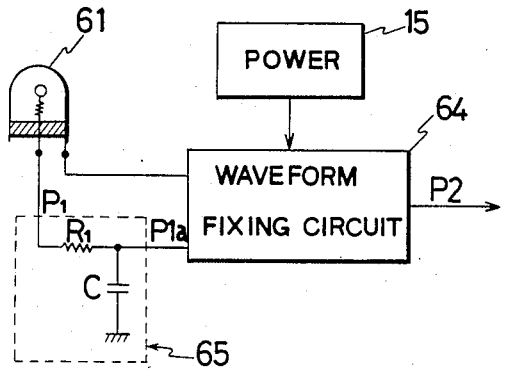
FIG. 14 shows a circuit diagram of an impact sensor and its peripheral circuit used in the present invention.

For avoiding such miss of detection, an integrating circuit 65 is provided before the waveform fixing circuit 64 as shown in FIG. 14. The integrating circuit 65 comprises a resistor R1 and a capacitor C, a time constant of which is determined according to the following circuits. By using the integrating circuit 65 a signal P1a of a given pulse width, e.g. not less than about 5 msec. can be obtained. Since almost of true chattering signals enter in a single pulse, any signal having a sufficient voltage can not be obtained by the integrating circuit 65, and thus the true chattering signal can never be processed as an effective signal. The integrated signals Pla is fixed by the waveform fixing circuit 64 to give a pulse P2 (FIG. 15).

Figure 16:
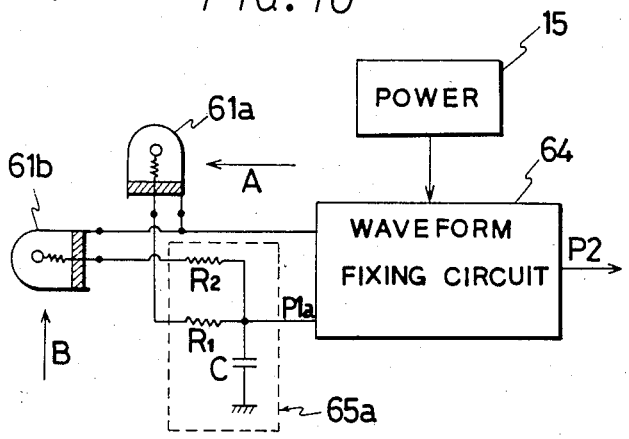
FIG. 16 shows another circuit diagram of impact sensors and their peripheral circuit used in the present invention.

In case of employing two impact sensors **61*a*, 61*b* which are traversely located as shown in FIG. 16, sensibility of the detection can be increased. In such construction, an impact force in the direction of an arrow A can be detected by the sensor 61*a*, while and an impact force in the direction of an arrow B can be detected by the sensor 61*b*. An integrating circuit 65*a* is also employed in this embodiment and comprises a resistor R1 for the sensor 61*a*, a resistor R2 for the sensor 61*b* and a capacitor C. Examples of the concrete values of the resistors and the capacitor are, for instance, about 10 KΩ and 0.002 μF, respectively. Since the weights and volumes of the resistors and the capacitor are very small, the incresses in weight and space of the circuit unit 3** may be negligible.

In FIG. 17 a preferable embodiment of the signal proccesing circuit is shown. The signal processing circuit comprises an AND gate 71 to one of whose imput terminals the pulse P2 is applied, a number counter 72 to which the output of the AND gate 71 is applied, and a comparator 73 to which the output of the number counter 72 and the signal corresponding to count "1" are applied. The comparator 73 produces an H (high) level output signal when both inputs coincide, that is, when the output of number counter 72 is equal to "1". The H level signal is applied to and drives a first stage circuit 74*a* of an electronic sound generating circuit 74. The electronic sound generating circuit 74 is divided into four stages, where the first stage circuit 74*a* generates a fixed period continuous sound, a second stage 74*b* generates a single momentary sound, a third stage 74*c* generates an intermittent sound, and a fourth stage 74*d* generates a fixed period continuous sound. Each output of the four stages 74*a*, 74*b*, 74*c*, 74*d*, which builts up an electronic sound generating circuit 74 is applied to a driver circuit 76 via an OR gate 75 to sound the buzzer 47. To a two-input AND gate 77, the output of the AND gate 71 and the output of the comparator 73 invertied via an inverter 78 are applied. The output of the AND gate 75 is applied to the second stage 74*b* of the electronic sound generating circuit 74. The clock pulse CP generated by the oscillator 37 is applied to a counting input of a time counter 80 via an AND gate 79. The numeral 81 indicates a set-reset circuit which produces reset and set signals in succession immediately after the pulse P2 arrives. The output of the circuit 81 is applied to the time counter 80. The content of the counter 80 is at first cleared by the reset signal, and then counting is enabled by the following set signal. The reset and set signals are synchronized with the clock pulse CP. The output of the time counter 80 is received by an multiplying circuit 82 which performs the following operation:

$$Y=(\alpha \cdot Ti)^{\beta} \quad (I)$$

wherein $\alpha$ and $\beta$ are constants satisfying $\alpha>10$ and $\beta \geqq 1$, and Ti is a time interval between the i-th pulse P2 and the (i+1)-th pulse P2 within the range of 0.25 sec $\leqq$ Ti $<$ 3.0 sec, and Y represents a score. The value of Y increases in a geometrical ratio as the time Ti increases. The curve of the relation between Y and Ti is shown in FIG. 18.

The result of the operation in the multiplying circuit 82 and the content of a latch circuit 83 are applied to an adder and added there. The result of the addition is presereved in the latch circuit 83. Thus, the total score up to the i-th is preserved in the latch circuit 83. Subsequently, when the (i+1)-th score is output from the multiplying circuit 82, the result is preserved at the latch 83 via the adder 84. The output pulse CP of the oscillator 37 is applied to a divider 85 which divides it to 1 Hz signal. The 1 Hz signal is applied to a display switching circuit 86 as a swiching signal. The display switching circuit 86 is also received the score information signal from the latch circuit 83 and the count information signal from the number counter 72, and is outputs the score information signal and the count information signal alternately in 1 Hz period by the switching signal. A display driving signal is obtained from the count information signal or the score information signal by a driver circuit 87. A comparator 89 receives the time signal Ti from the time counter 80 and a time signal To which is set to a maximum period as a reference input signal. The comparator 89 outputs an L (low) level signal when the state satisfies the relation Ti $<$ To is recognized as normal state. In this embodiment, the time To is set to 3 sec. The set of the time To is on the basis of the estimation that, in general ball lifting game, the time interval from the first impact to the second impact corresponds to a height of the ball kicked up, and that since high technique is required to keep the ball kicked up high, the time To cannot be too long without restriction. As a result, 3 seconds will be the limit for considering the technical level of an ordinary player.

The output of the comparator 89 is applied to the third stage circuit 74*c* of the electronic sound generating circuit 74, and at the same time to the AND gates 71, 79 via a NOR gate 90. Thus, if the pulse P2 is not generated within the time To from the previous pulse P2, the output of the comparator 89 changes to H level, hence the output of the NOR gate 90 is turned to L level, and then the AND gates 71, 79 are cut off. In such case, time over or rule violation is indicated by an electronic sound (intermittent sound). Moreover in such case, it must be controlled to prevent the content of the time counter 80 having counts up to the time To since the last output pulse of the pulse P2 from being transferred to the multiplying circuit 82. This is accomplished by means of the signal from the set-reset circuit 81, by performing the operation according to the content of the time counter 80 having counts from the i-th pulse to the (i+1)-th pulse at the time when the (i+1)-th pulse P2 arrives.

A comparator 91 receives the time signal Ti from the time counter 80 and a time signal Ts which is set to a minimum period as a reference input signal. The comparator 91 outputs a L level signal when the state satisfies the relation Ti $\geqq$ Ts is recognized as normal state. In this embodiment, the time Ts is set to 0.25 sec. The set of the time Ts is determined for eliminating cases where the time interval of successive impacts is extremely short, for instance, a case where the ball falls on the ground and its bound decreases naturally, or a case where a height of the kick is restrained extremely low for increasing the number of kicks. When the time Ti is less than the reference time Ts, the output of the comparator 91 changes to H level, and then the output of the NOR gate 90 is turned to L level to cut off the AND gates 71, 79, whereby the counting action of the number counter 72 and the time counter 80 is halted.

In FIG. 17, an arrow R indicates the reset signal generated when the switch 49 is operated or the power supply is turned on.

Circuit operation is explained hereinbelow. In the initial state each circuit is in reset condition, the outputs of the comparator 89, 91 are both in L level, and the output of the NOR gate 90 is in H level, hence the AND gates 71, 79 are open. In such state, if the first impact pulse P2 is generated by the application of external force to the ball 1 by a kcik and the like, the pulse P2 is input at the number counter 72 and the set-reset circuit 81 via the AND gate 71. When count "1" occurs at the number counter 72, both inputs of the comparator 73 becomes "1", and thus a H level signal is obtained at its output. The first stage circuit 74*a* of the electronic sound generating circuit 74 is activated by the H level signal, and a continuous sound of fixed duration time which indicates the start of the game is generated. The counting signal of the number counter 72 is applied to the driver circuit 87 via the display switching circuit 86 with 1 Hz switching period, and then a numeral "1" is displayed on the display panel 6 in 1 Hz period.

When the second impact pulse P2 enters, the content of the number counter 72 is changed to "2". In such case, since the two inputs of the comparator 73 are not coincident, the output of the comparator 73 changes to L level, and then the output of the inverter 78 becomes "H". As a result, two inputs of the AND gate 77 becomes both "H" to give an output in H level. The second stage circuit 74*b* of the electronic sound generating circuit 74 is activated by this H level signal, and a single momentary sound is generated. This indicates the state that the application of external force is the second or more times application. When the second impact pulse P2 is applied to the time counter 80, the content of the counter up to the application of the pulse is applied to the multiplying circuit 82 where score conversion is performed in the same manner as mentioned above. At first, the content of the latch circuit 83 is equal to zero. The result of the operation is stored at the latch circuit 83 via the adder 84, and the score information is given to the display panel 6 via the display switching circuit 86. Thus, the content of the number counter 72, i.e. a numeral and the abovementioned score are displayed alternately on the display panel 6 with the period of 1 second. Subsequently, every application of an impact pulse P2, the content of the number counter 72 is incremented by 1, while the content of the time counter 80 is processed by the multiplying circuit 82 and accumulated to the latch circuit 83 as a score information.

If one impact pulse P2 is generated and the next pulse P2 is not entered in time To (3 seconds), the output of the comparator 89 is turned to H, whereby the AND gates 71, 79 are closed to inhibit the supply of the counting signal to the number counter 72 and the time counter 80, and at the same time, the third stage circuit 74*c* of the electronic sound generating circuit 77 is activated which generates an intermittent sound of a fixed duration time. This electronic sound indicates the state of time over or rule violation.

On the other hand, when the ball falls on the ground and its bound decreases at the end of the game, the pulse interval of the impact pulse P2 becomes gradually shorter. At the time when the interval becomes less the than time Ts (0.25 second), the output of the comparator 91 is truned to "H", whereby the AND gates 71, 79 are closed via the NOR gate 90. As a result, the counting actions of the number counter 41 and the time counter 80 are stopped as mentioned above, and at the same time, the fourth stage circuit 74*d* of the electronic sound generating circuit 74 is activated, which generates a countinuous sound of a fixed duration time. This electronic sound indicates the end of the game.

The game is to compete for the number of ball liftings and for the score considering difficulty in addition to the lifting counts, both of which are displayed alternately on the display panel 6.

Figure 19:
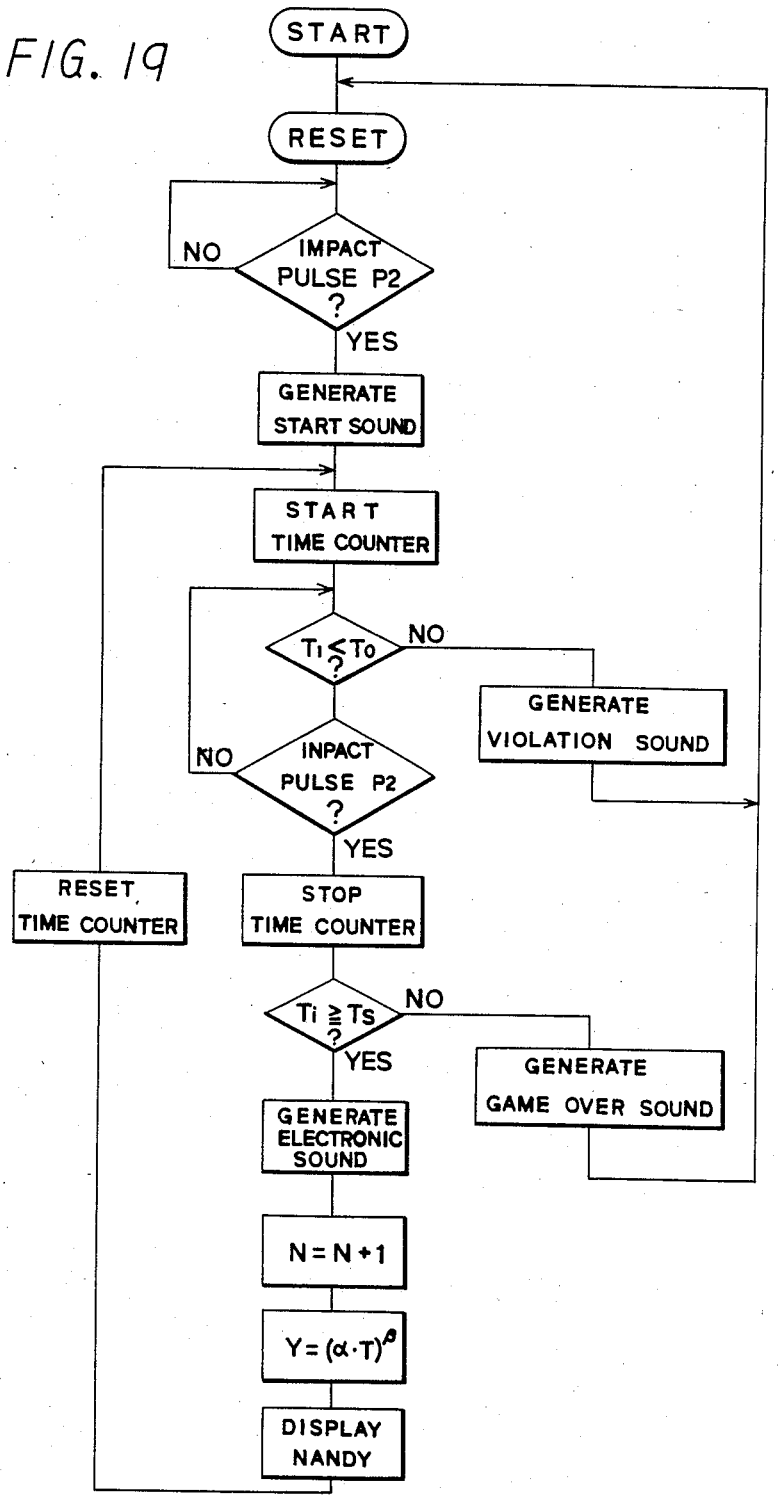
FIG. 19 shows a chart of a relation between score Y and time Ti.

The desired purpose can be achieved by employing the circuit configuration described above, but a similar processing can be performed with a microcomputer. This processing is explained with the flow chart in FIG. 19. When it is started by turning the power on, the operation part, the memory part and the other parts are reset at first. It is followed by the check whether an impact pulse P2 is entered or not, and a countinuous starting sound is generated if the pulse P2 exists. Then the counting is started at the time counter. In the following step the time count Ti is compared with the maximum reference time To, and if it is judged $Ti \geqq To$, which is regarded as time over, the sate of rule violation is indicated by an intermittent electronic sound. After such electronic sound it returnes to initial state. If the second impact pulse P2 is entered within the period, i.e. a time satisfying the condition $Ti < To$, the counting of the time counter is halted and the time count Ti is compared with the minimum reference time Ts. At this step, if it is judged Ti Ts, i.e. in normal state, a single electronic sound is generated, while if it is judged $Ti < Ts$, which is regarded as game over, the count and score until then is displayed, and at the same time an end informing sound is generated, followed by returning to initial state. When it is judged $Ti \geqq Ts$ as mentioned above and the number counting is performed, it is followed by the calculation of the score. This is done by the above-mentioned equation (I), where its accumulation is also carried out. This is shown by the equation (II).

$$Y = \sum_{i=1}^{N} (\alpha \cdot Ti)^{\beta} \qquad \text{(II)}$$

The resulting calculated score Y and the number of impacts N are displayed on the display panel alternately. After such processes, the content of the time counter is reset, followed by returning to the step, and then are repeated every application of the impact pulse, and the number counting and the score calculation are performed.

Figure 20:
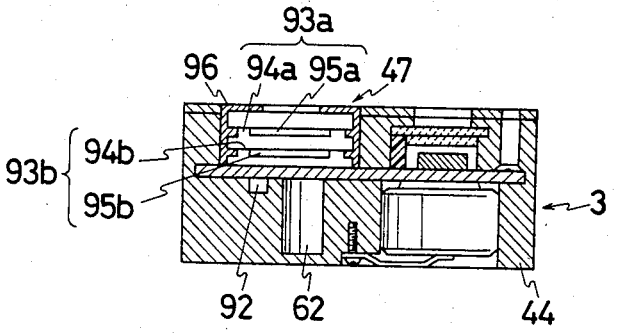
FIG. 20 shows a sectional view of another circuit unit used in the present invention.

Another embodiment of the circuit unit 3 is shown in FIG. 20, in which a piezoelectric device is used as an impact sensor instead of a mechanical structured impact sensors 57, 61. In this embodiment a two stage structure is adopted for the piezoelectric buzzer 47. One stage is a sound generating part 93*a* comprising a stainless steel plate 94*a* and a ceramic plate 95*a* functioning as a piezoelectric device, and the other stage is an impact sensor part 93*b* comprising a stainless plate 94*b* and a ceramic plate 95*b*. The both parts are housed in a plastic case 96. In the mold body 44, there are buried a step up coil 62 for increasing the sound level generated by the sound generating part 93*a* and a transistor chip 92 for fixing the waveform of the impact pulses obtained at the impact sensor part 93*b*. Explanation of the other components and the parts are omitted because they are same as thoes in FIG. 10.

Figure 21:
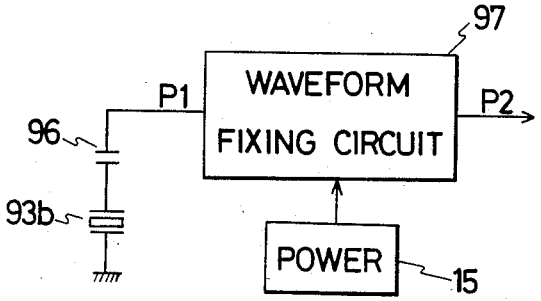
FIG. 21 shows a circuit diagram of the sensor and its peripheral circuit according to FIG. 20.

In FIG. 21 a circuit block diagram when the piezoelectric device is used as the impact sensor is shown. In this embodiment, one end of the impact sensor is grounded, while the other end is connected to a waveform fixing circuit 97 via a capacitor 96. The waveform fixing circuit 97 can be constructed by a single stage of the transistor 92.

Figure 22:
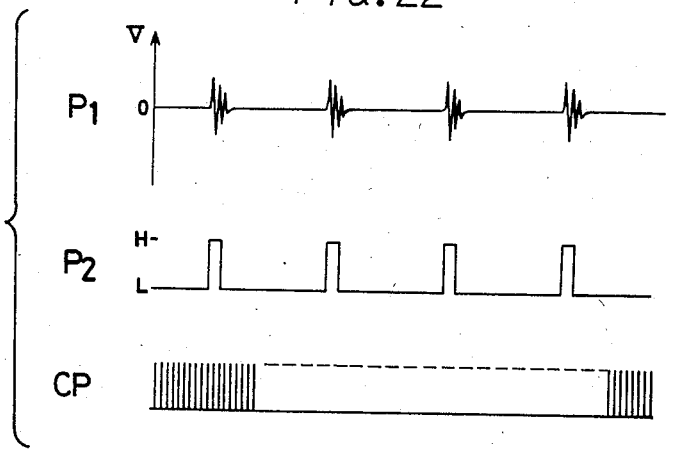
FIG. 22 shows a signal waveform chart obtained in the embodiment according to FIG. 21.

In FIG. 22 a signal waveform chart obtained in the embodiment of FIG. 21 is shown. The impact pulse P1 is generated by the impact sensor part 93*b* when an impact is applied to the ball and fixed to the waveform output pulse P2. CP is the clock pulse mentioned above. The impact pulse P2 is processed by the signal processing circuit shown in FIG. 17, or according the program flow chart shown in FIG. 19.

In the above explanation, though the athletic ball of the present invention is mainly adapted to the soccer ball, a similar structure can be take also in a volleyball. The exercise that some people form a circle and repeat passing the volleyball without dropping it on the ground is usually seen as a recreation or a practice of inexperienced players. According to the present invention, the number of passes and the score considering the duration time of the passes in the air can be displayed, and at the same time, informing sound can be generated with every pass, which make interest to this kind of exercise double. In this case the times To and Ts should be set up properly according to the kind of exercise.

According to the present invention the ball itself is provided with the detecting means for detecting the external force applied thereto and the means for counting the detected signal and for displaying it, so that the player, without need to count the number of action by himself, can concentrate on his play. Also according to the present invention, the height of the ball kicked up is convertd to a score and displayed, which make an objective evaluation of the athletic technique possible. The score can be used as a means to evaluate a soccer player's lifting technique. Moreover, since the ball of the present invention can generate an informing sound on a kick and a different sound at the end of the game or on the detection of a rule violation, interest of the user is increased and the ball adequate to an infant's play is realized. Furthermore, since the lifting game or a game similar to Kemari by using the ball of present invention which does not require a wide playing area, one can play alone and enjoy as a handy sport.

According to the present invention the circuit unit is placed under the ball surface so as to maintain the airtight state of the airtight bladder, that is to say, an isolated state from the inside of the bladder without exposing a part of the circuit unit in the bladder, which can maintain the airtightness equal to a conventional ball.

What is claimed is:

1. An athletic ball, comprising:

(a) a ball having an airtight bladder for giving impact resilience to the ball in which compressed air is charged through an air injection valve, (b) a concave housing provided within the ball on the opposite portion of the ball from the valve and contacting the surface of the bladder while maintaining the airtightness of the bladder, (c) means for detecting an external force applied to the ball and generating a signal in response thereto, (d) operation means for converting the signal from the detecting means into a numerical information signal relating to the external force applied to the ball, (e) means for displaying the numerical information obtained in the operation means, and (f) a battery power source for driving the above means, said detecting means, operation means, displaying means and battery power source being accommodated in the housing, and the sum of the weight of the housing, the detecting means, the operation means, displaying means and battery power source being substantially the same as the weight of the valve, and said weight sum being small enough such that said housing and elements disposed therein do not substantially interfere with the impact resilience of the ball.

2. The athletic ball of claim 1, wherein a detecting means comprises an integrating circuit for integrating the detected impact signals.

3. The athletic ball of claim 1, wherein a cover of the ball has a transparent part at a region corresponding to the surface of the display means so as to be capable of seeing the display on the display panel when the cover is attached to the ball.

4. The athletic ball of claim 1, wherein the operation means comprises a number counter for counting the number of applications of external force to the ball, and the content of the number counter is displayed on the display means.

5. An athletic ball, comprising:

(a) a ball having an airtight bladder for giving impact resilience to the ball in which compressed air is charged through an air injection valve, (b) a concave housing provided within the ball on the opposite portion of the ball from the valve and contacting the surface of the bladder while keeping the airtightness of the bladder, (c) a cover for concealing an opening in the housing, (d) means for detecting an external force applied to the ball, (e) operation means for converting the signal from the detecting means into a numerical information signal relating to the external force, (f) means for displaying the numerical information obtained in the operation means, and (g) a battery power source for driving the above means, said detecting means, operation means, displaying means and battery power source being accommodated in the housing, and the sum of the weights of the housing, the cover, the detecting means, operation means, displaying means and battery power source being substantially the same as the weight of the valve, and said weight sum being small enough such that said housing and those elements disposed therein do not substantially interfere with this impact resilience of the ball.

6. The athletic ball of claim 5, wherein the detecting means comprises an integrating circuit for integrating the detected impact signals.

7. The athletic ball of claim 5, wherein the cover has a transparent part at a region corresponding to the surface of the display means so as to be capable of seeing the display on the display panel when the cover is attached to the ball.

8. The athletic ball of claim 5, wherein the operation means comprises a number counter for counting the number of applications of external force to the ball, and the content of the number counter is displayed on the display menas.

9. The athletic ball of claim 5, wherein the operation means comprises a time counter for counting a time interval of two successive applications of external force to the ball and means for multiplying the content of the time counter by a certain coefficient which is predetermined depending on the value of the content of the time counter, and the result of the multiplication is displayed on the display means.

10. The athletic ball of claim 5, wherein the operation means comprises a number counter for counting the number of applications of external forces to the ball, a time counter for counting a time interval of two successives applications of external force to the ball and means for multiplying the content of the time counter by a certain coefficient which is predetermined depending on the value of the content of the time counter, and the result of the multiplication and the content of the number counter are displayed on the display means alternately in a given period.

11. The athletic ball of claim 10, wherein the operation means comprises means for judging whether or not the content of the time counter is within a given period which is defined by a minimum period determined on the basis of bounds of the ball and a maximum period on the basis of a duration time of the ball in the air, and means for inhibiting the counting operations of the number counter and the time counter when the content of the time counter is outof the given period.

12. An athletic ball, comprising (a) a ball having an airtight bladder for giving impact impact resilience to the ball in which compressed air is charged through an air injection valve,
(b) a concave housing provided within the ball on the opposite portion of the ball from the valve and being in contact with the surface of the bladder while keeping the airtightness of the bladder,
(c) a cover for concealing an opening in the housing,
(d) means for detecting an external force applied to the ball,
(e) operation means for converting the signal from the detecting means into a numerical information signal relating to the external force,
(f) means for generating various information sounds according to the numerical information signal, and
(g) a battery power source for driving the above means; said detecting means, operation means, generating means and battery power source being accommodated in the housing, and the sum of the weights of the housing, the cover the detecting means, the operation means, the generating means and battery power source being substantially the same as the weight of valve, and said weight sum being small enough such that said housing and those elements disposed therein do not substantially interfere with the impact resilience of the ball.

13. The athletic ball of claim 12, wherein the detecting means comprises an integrating circuit for integrating the detected impact signals.

14. The athletic ball of claim 12, wherein the detecting means comprises a piezoelectric device.

15. The athletic ball of claim 14, wherein the sound generating means comprises a piezoelectric device, and the two piezoelectric devices of the detecting means and the sound generating means are accomondated within a hollow casing in a two-stage structure.

16. The athletic ball of claim 12, wherein the operation means comprises a number counter for counting the number of applications of external force to the ball, and the sound generating means is activated to generate the information sound when the content of the number counter is changed, and a kind of said sound generated in case where the content of the number counter is "1" is different from a kind of the sound generated in case where the content of the number counter is more than "1".

17. The athletic ball of claim 12, wherein the operation means comprises a time counter for counting a time interval of two successive applications of external force to the ball and means for judging whether or not the content of the time counter is within a given period which is defined by a minimum period determined on the basis of bounds of the ball and a maximum period determined on the basis of a duration time of the ball in the air, and the sound generating means generates an information sound when the content of the time counter is judged to be outof the given period by the judging means, and said generated information sound is different from the sounds generated when the content of the time counter is "1" or more.

18. An athletic ball, comprising:
(a) a ball having an airtight bladder for giving impact resilience to the ball in which compressed air is charged through an air injection valve,
(b) a concave housing provide within the ball on the opposite portion of the ball from the valve and being in contact with the surface of the bladder while keeping the airtightness of the bladder,
(c) a cover for concealing an opening in the housing,
(d) means for detecting an external force applied to the ball,
(e) operation means for converting the signal from the detecting means into a numerical information signal relating to the external force,
(f) means for displaying the numerical information obtained in the operation means,
(g) means for generating various information sounds according to the numerical information signal, and
(h) a battery power source for driving the above means; said detecting means, operation means, the displaying means, the sound generating means and the battery power source being accommodated in the housing, and the sum of the weights of the housing, the cover, the detecting means, the operation means, the displaying means, the sound generating means and the battery power source being substantially the same as the weight of the valve, and said weight sum being small enough such that said housing and those elements disposed therein do not substantially interfere with the impact resilience of the ball.

19. The athletic ball of claim 18, wherein the operation means comprises a number counter for counting the number of applications of external force to the ball, the content of said number counter being displayed on the display means, and the sound generating means comprises means for driving the sound generating means when the content of the number counter is changed.

* * * * *